US011309664B2

(12) United States Patent
Wang et al.

(10) Patent No.: US 11,309,664 B2
(45) Date of Patent: Apr. 19, 2022

(54) RADIO-FREQUENCY CONNECTOR ASSEMBLY

(71) Applicant: SUNWAY COMMUNICATION (JIANGSU) CO., LTD., Changzhou (CN)

(72) Inventors: Stanley Wang, Changzhou (CN); Ren-Chih Li, Changzhou (CN); Yule Su, Shenzhen (CN)

(73) Assignee: SUNWAY COMMUNICATION (JIANGSU) CO., LTD., Changzhou (CN)

( * ) Notice: Subject to any disclaimer, the term of this patent is extended or adjusted under 35 U.S.C. 154(b) by 0 days.

(21) Appl. No.: 17/029,273

(22) Filed: Sep. 23, 2020

(65) Prior Publication Data

US 2021/0305753 A1 Sep. 30, 2021

Related U.S. Application Data

(63) Continuation of application No. PCT/CN2020/107729, filed on Aug. 7, 2020.

(30) Foreign Application Priority Data

Mar. 30, 2020 (CN) ..... 202010234186.2

(51) Int. Cl.
*H01R 13/6581* (2011.01)
*H01R 13/6594* (2011.01)
(Continued)

(52) U.S. Cl.
CPC ..... *H01R 13/6581* (2013.01); *H01R 13/646* (2013.01); *H01R 13/6585* (2013.01);
(Continued)

(58) Field of Classification Search
CPC ..... H01R 12/52; H01R 12/714; H01R 12/57; H01R 12/775; H01R 12/88; H01R 12/62;
(Continued)

(56) References Cited

U.S. PATENT DOCUMENTS 8,007,317 B2 * 8/2011 Su ..... H01R 13/502 439/607.46
8,043,114 B2 * 10/2011 Kaneko ..... H01R 12/716 439/497

* cited by examiner

*Primary Examiner* — Abdullah A Riyami
*Assistant Examiner* — Justin M Kratt
(74) *Attorney, Agent, or Firm* — Oliff PLC

(57) ABSTRACT

A radio-frequency connector assembly includes a male connector and a female connector, which is plugged and matched with the male connector. The male connector includes a male substrate and a shielding case covering the male substrate. The female connector includes a female substrate and a shielding frame having the female substrate disposed therein. Multiple bumps which are distributed along an inner peripheral wall of the shielding case are disposed on at least one of the inner peripheral wall of the shielding case and an outer peripheral wall of the shielding frame, and a distance between every two adjacent bumps is less than or equal to one quarter wavelength of the operating frequency of the radio-frequency connector assembly. Signals in all directions can be shielded in the connector, effectively improving the shielding effect of the radio-frequency connector and the electrical properties of the radio frequency connector.

10 Claims, 5 Drawing Sheets

(51) Int. Cl.

| | |
|---|---|
| ***H01R 13/646*** | (2011.01) |
| ***H01R 13/6585*** | (2011.01) |
| *H01R 13/6461* | (2011.01) |
| *H01R 13/648* | (2006.01) |
| *H01R 12/70* | (2011.01) |
| *H01R 12/71* | (2011.01) |
| *H01R 12/59* | (2011.01) |
| *H01R 12/52* | (2011.01) |
| *H01R 12/88* | (2011.01) |
| *H01R 12/77* | (2011.01) |
| *H01R 13/658* | (2011.01) |
| *H01R 12/62* | (2011.01) |

(52) U.S. Cl.

CPC ..... *H01R 13/6594* (2013.01); *H01R 12/52* (2013.01); *H01R 12/598* (2013.01); *H01R 12/62* (2013.01); *H01R 12/7005* (2013.01); *H01R 12/712* (2013.01); *H01R 12/714* (2013.01); *H01R 12/716* (2013.01); *H01R 12/775* (2013.01); *H01R 12/88* (2013.01); *H01R 13/648* (2013.01); *H01R 13/6461* (2013.01); *H01R 13/658* (2013.01)

(58) Field of Classification Search

CPC .. H01R 12/598; H01R 13/658; H01R 12/716; H01R 12/7005; H01R 12/712; H01R 13/6581; H01R 13/6585; H01R 12/6594; H01R 13/646; H01R 13/648; H01R 13/6461

USPC ..... 439/71–74, 330, 525, 497, 607.01, 439/607.04, 607.05, 607.08, 607.46

See application file for complete search history.

RADIO-FREQUENCY CONNECTOR ASSEMBLY

BACKGROUND

1. Technical Field

The invention relates to the technical field of connectors, in particular to a radio-frequency connector assembly.

2. Description of Related Art

Radio-frequency connector assemblies typically comprise a radio-frequency line, a male connector, a female connector and a circuit board, wherein the radio-frequency line is connected and conductive with the male connector to form a male connector assembly, the female connector is mounted on the circuit board to form a connector female assembly, the male connector comprises a male substrate and a male signal terminal disposed on the male substrate, and the female connector comprises a female substrate and a female signal terminal disposed on the female substrate.

BRIEF SUMMARY OF THE INVENTION

The technical issue to be settled by the invention is to provide a radio-frequency connector assembly which has a good shielding effect.

The technical solution adopted by the invention to settle the aforesaid technical issue is as follows: a radio-frequency connector assembly comprises a male connector and a female connector which are plugged and matched with each other, wherein the male connector comprises a male substrate, the female connector comprises a female substrate, the male connector further comprises a shielding case which covers the male substrate, the female connector further comprises a shielding frame, the female substrate is disposed in the shielding frame which is covered with the shielding case, multiple bumps which are distributed along an inner peripheral wall of the shielding case are disposed on the inner peripheral wall of the shielding case and/or on an outer peripheral wall of the shielding frame, and the distance between every two adjacent bumps is less than or equal to one quarter wavelength of the operating frequency of the radio-frequency connector assembly.

The invention has the following beneficial effects: multiple bumps are disposed in a gap between the shielding case and the shielding frame, and the distance between every two adjacent bumps is less than one quarter wavelength of the operating frequency of the radio-frequency connector assembly, so that signals in the X-axis/Y-axis/Z-axis direction can be shielded in the connector and will be radiated to the outside of the connector, thus avoiding signal leakage; moreover, signals from the outside of the connector can be prevented from entering the connector, so that signal interference is avoided, and the electrical properties of the radio frequency connector are effectively improved.

REFERENCE SIGNS

Figure 1:
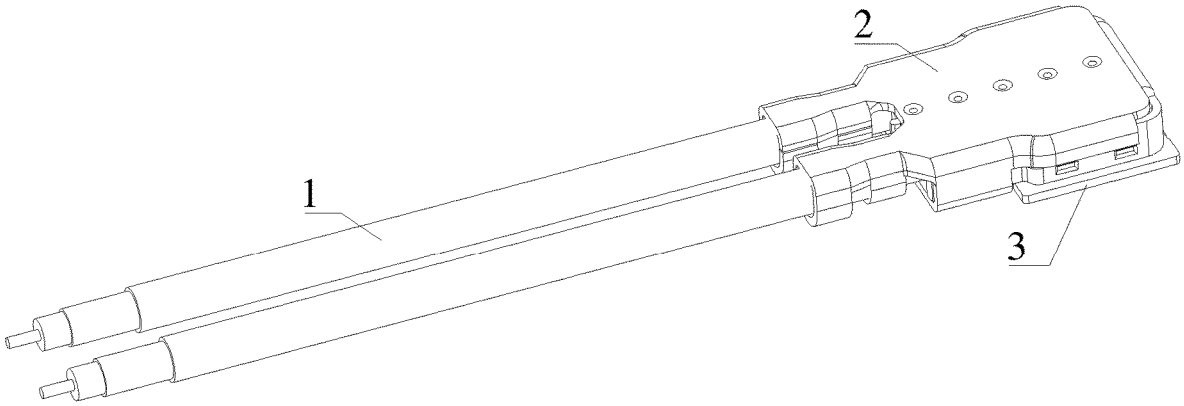
FIG. 1 is an overall structural view of a radio-frequency connector assembly in Embodiment 1 of the invention.

1, radio-frequency line; 2, male connector; 21, male substrate; 22, shielding case; 221, top plate; 222, peripheral plate; 223, spacer; 3, female connector; 31, female substrate; 32, shielding frame; 321, edge guard; 41, bump; 42, slot; 51, male signal terminal; 52, female signal terminal; 61, protrusion; 62, groove.

DETAILED DESCRIPTION OF THE INVENTION

The technical contents, purposes and effects of the invention are expounded below in conjunction with the embodiments and accompanying drawings.

Referring to FIG. 1 to FIG. 8, a radio-frequency connector assembly comprises a male connector 2 and a female connector 3 plugged and matched with the male connector 2, wherein the male connector 2 comprises a male substrate 21, the female connector 3 comprises a female substrate 31, the male connector 2 further comprises a shielding case 22 which covers the male substrate 21, the female connector 3 further comprises a shielding frame 32, the female substrate 31 is disposed in the shielding frame 32 which is covered with the shielding case 22, multiple bumps 41 which are distributed along an inner peripheral wall of the shielding case 22 are disposed on the inner peripheral wall of the shielding case 22 and/or on an outer peripheral wall of the shielding frame 32, and the distance between every two adjacent bumps 41 is less than or equal to one quarter wavelength of the operating frequency of the radio-frequency connector assembly.

The structural principle of the invention is as follows: with the increase of the wavelength, the energy of waves is less likely to be attenuated; in the propagation process of the waves, secondary waves will be excited every time the waves encounter a medium boundary; this is the same to gaps, the energy passing through the gaps will be sharply reduced when the gaps are excessively small, which means that the propagation of electromagnetic waves is prevented, that is, signals are shielded. After the male connector 2 and the female connector 3 are connected, a gap is formed between every two adjacent bumps 41, and the length of the gap can be controlled by controlling the distance between the two adjacent bumps 41, so that the propagation of electromagnetic waves is prevented.

From the above description, the invention has the following beneficial effects: the multiple bumps 41 are disposed in the gap between the shielding case 22 and the shielding frame 32, and the distance between every two adjacent bumps 41 is less than one quarter wavelength of the operating frequency of the radio-frequency connector assembly, so that signals in the X-axis/Y-axis/Z-axis direction can be shielded in the connector and will be radiated to the outside of the connector, thus avoiding signal leakage; moreover, signals from the outside of the connector can be prevented from entering the connector, so that signal interference is avoided, and the electrical properties of the radio-frequency connector are effectively improved.

Furthermore, the radio-frequency connector assembly further comprises a radio-frequency line 1 and a circuit board, wherein the male connector 2 is connected to the radio-frequency line 1, and the shielding case 22 is conductive with a ground terminal of the radio-frequency line 1; the female connector 3 is connected to the circuit board, the shielding frame 32 is of a peripherally-seamless structure, the bottom of the shielding frame 32 contacts with the circuit board, and an annular contact region is formed.

From the above description, the shielding frame 32 of the peripherally-seamless structure has a good shielding effect. It can be easily understood that the shielding frame 32 of the peripherally-seamless structure can be manufactured through a drawing process, a cold forging process, a powder metallurgy process, or the like.

Furthermore, an edge guard 321 which extends outwards is disposed at the bottom of the shielding frame 32.

From the above description, the female connector 3 can be easily connected to an external component (such as a circuit board) through the edge guard 321; moreover, the edge guard 321 effectively enlarges the contact area between the bottom of the shielding frame 32 and the circuit board, thus further improving the shielding effect of the connector.

Furthermore, the shielding case 22 comprises a top plate 221, and a peripheral plate 222 is disposed on an edge of the top plate 221 and is a peripherally-closed structure with a line inlet.

From the above description, an inner wall of the peripheral plate 222 is the inner peripheral wall of the shielding case 22. All regions, except the line inlet, can be shielded by the shielding case 22 in multiple directions, so that signal leakage and signal interference can be effectively prevented, and the shielding effect of the radio-frequency connector assembly is improved.

Furthermore, the shielding case 22 is buckled on the shielding frame 32 through the bumps 41, and slots 42 matched with the bumps 41 are formed in regions, corresponding to the bumps 41, of the inner peripheral wall of the shielding case 22 or of the outer peripheral wall of the shielding frame 32.

From the above description, the bumps 41 can improve the shielding effect and can connect the shielding case 22 and the shielding frame 32.

Furthermore, the male substrate 21 is provided with a male signal terminal 51, and the female substrate 31 is provided with a female signal terminal 52 matched with the male signal terminal 51.

Furthermore, the male substrate 21 is provided with multiple male signal terminals 51, and every two adjacent male signal terminals 51 are isolated by a spacer 223 which is conductive with the shielding case 22; multiple female substrates 31 and multiple shielding frames 32 are disposed in the female connector 3, the female substrates 31 are in one-to-one correspondence with the shielding frames 32, each female substrate 31 is provided with a female signal terminal 52 matched with one male signal terminal 51, every two shielding frames 32 are fixedly connected, and the spacer 223 is inserted between two adjacent shielding frames 32, so that signal interference between the signal terminals is avoided.

From the above description, the radio-frequency connector assembly may be of various structures. For example, the radio-frequency connector assembly may be a single-path radio-frequency connector or a multi-path radio-frequency connector. In the multi-path radio-frequency connector, the spacer 223 can isolate two adjacent paths to avoid mutual interference, so that the shielding effect is further improved.

Furthermore, multiple protrusions 61 which are conductive with the shielding frame 32 are disposed two sides of the spacer 223, and the distance between every two adjacent protrusions 61 in a lengthwise direction of the spacer 223 is less than or equal to one quarter wavelength of the operating frequency of the radio-frequency connector assembly.

From the above description, the protrusions 61 improve the internal shielding effect of the radio-frequency connector, thus further improving the electrical properties of the radio-frequency connector assembly.

Furthermore, the shielding case 22 comprises a top plate 221, and all regions of the top surface of the spacer 223 conductively contact with the top plate 221.

From the above description, the spacer 223 is stably connected to the male substrate 21, so that the isolation effect is good.

Furthermore, a peripheral plate 222 is disposed on an edge of the top plate 221 and is of a peripherally-closed structure with a line inlet, and a gap is formed between a front end face of the spacer 223 and the peripheral plate 222; or, at least one part of the front end face of the spacer 223 conductively abuts against the peripheral plate 222.

From the above description, when a gap is reserved between the front end face of the spacer 223 and the peripheral plate 222, the male substrate 21 can be formed easily, and the machining difficulty of the male connector 2 is reduced; when at least one part of the front end face of the spacer 223 conductively abuts against the peripheral plate 222, the shielding performance of the connector assembly can be further improved.

Embodiment 1

Figure 2:
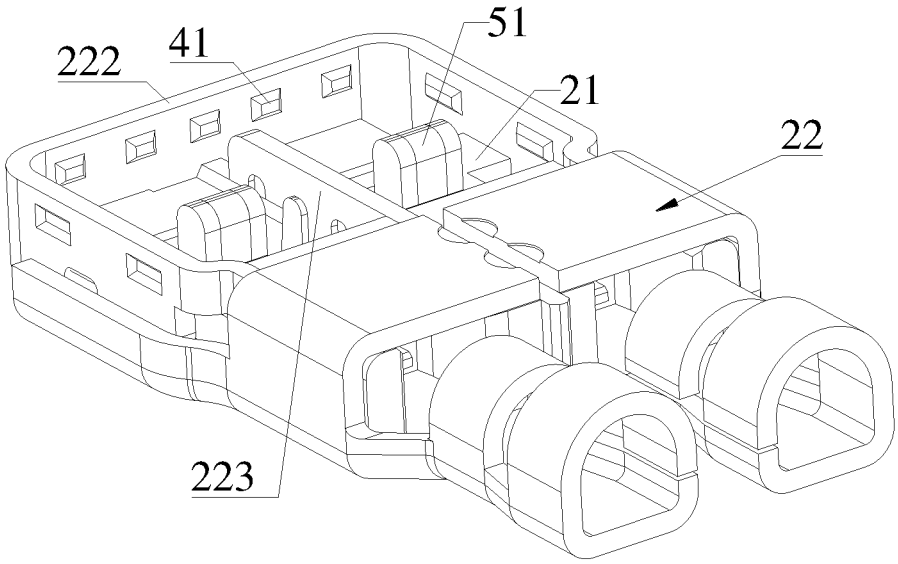
FIG. 2 is a structural diagram of a male connector of the radio-frequency connector assembly in Embodiment 1 of the invention.
Figure 3:
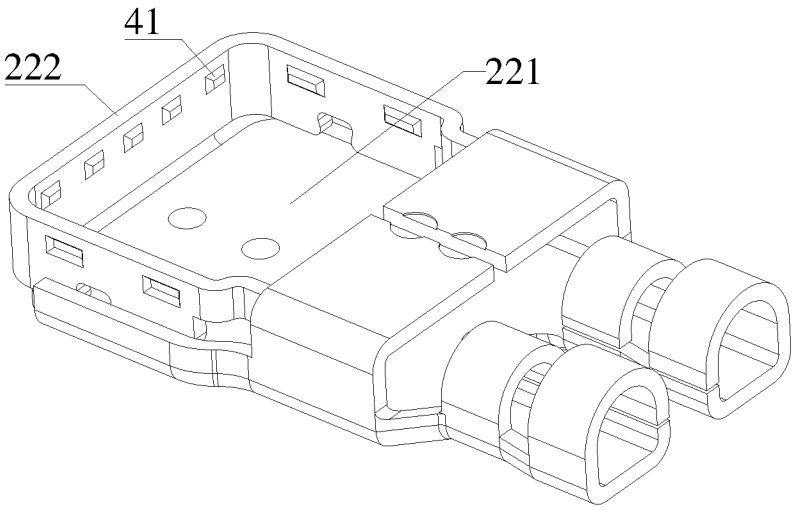
FIG. 3 is a structural view of a shielding case of the radio-frequency connector assembly in Embodiment 1 of the invention.
Figure 4:
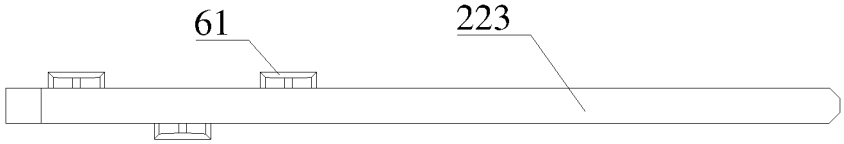
FIG. 4 is a top view of a spacer of the radio-frequency connector assembly in Embodiment 1 of the invention.
Figure 5:
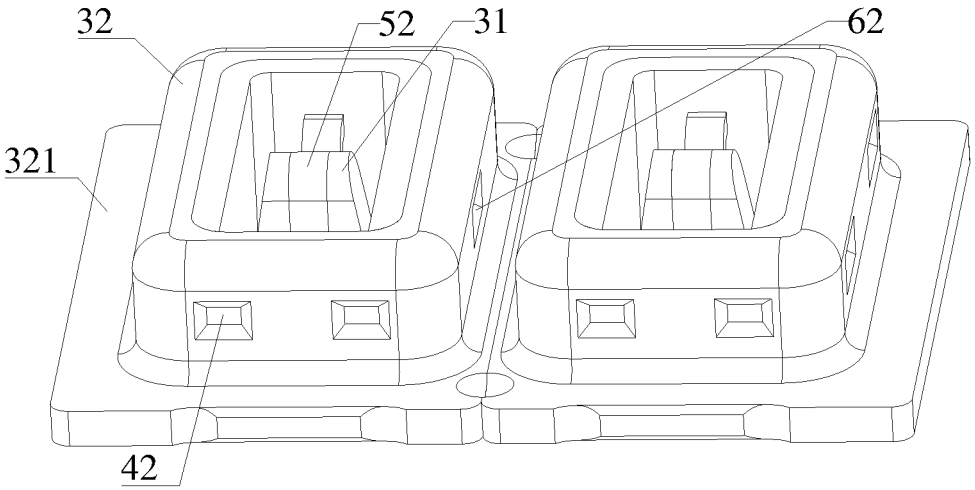
FIG. 5 is a structural view of a female connector of the radio-frequency connector assembly in Embodiment 1 of the invention.

Referring to FIG. 1 to FIG. 5, Embodiment 1 of the invention is as follows: as shown in FIG. 1, FIG. 2 and FIG. 5, a radio-frequency connector assembly comprises a radio-frequency line 1, a circuit board (not shown), a male connector 2 and a female connector 3 plugged and matched with the male connector 2, wherein the male connector 2 comprises a male substrate 21, the female connector 3 comprises a female substrate 31, the male connector 2 further comprises a shielding case 22 covering the male substrate 21 and is connected to the radio-frequency line 1, the shielding case 22 is conductive with a ground terminal of the radio-frequency line 1, the female connector 3 further comprises a shielding frame 32, the female substrate 31 is disposed in the shielding frame 32, the female connector 3 is connected to the circuit board, the shielding frame 32 is a peripherally-seamless structure, the bottom of the shielding frame 32 contacts with the circuit board, an annular contact region is formed and is a ground region of the shielding frame 32, the shielding frame 32 is covered with the shielding case 22, multiple bumps 41 which are distributed along an inner peripheral wall of the shielding case 22 are disposed on the inner peripheral wall of the shielding case 22 and/or on an outer peripheral wall of the shielding frame 32, and the distance between every two adjacent bumps 41 is less than or equal to one quarter wavelength of the operating frequency of the radio-frequency connector assembly. The radio-frequency connector assembly in this embodiment can be used for 5G transmission; according to formulas λ=C/freq/sqrt(er), C=3*10^8 m/s, and er=3, the distance between every two adjacent bumps is 0.82 mm when the operating frequency f of the radio-frequency connector assembly is 52.6 GHz and the wavelength λ is 3.29 mm.

Referring to FIG. 1 and FIG. 5, an edge guard 321 which extends outwards is disposed at the bottom of the shielding frame 32. The edge guard 321 can increase the width of the annular contact region, thus improving the shielding performance of the female connector 3. Optionally, the bottom of the shielding case 22 abuts against the top surface of the edge guard 321.

As shown in FIG. 3, specifically, the shielding case 22 comprises a top plate 221, wherein a peripheral plate 222 is disposed on an edge of the top plate 221 and is of a peripherally-closed structure with a line inlet.

As shown in FIG. 2 and FIG. 5, optionally, the shielding case 22 is buckled on the shielding frame 32 through the bumps 41, and slots 42 matched with the bumps 41 are formed in regions, corresponding to the bumps 41, of the inner peripheral wall of the shielding case 22 or of the outer peripheral wall of the shielding frame 32. After the male connector 2 and the female connector 3 are connected, the shielding case 22 is conductive with the shielding frame 32 through the bumps 41.

When the radio-frequency connector assembly is a single-path connector, the male substrate 21 is provided with a male signal terminal 51, and the female substrate 31 is provided with a female signal terminal 52 matched with the male signal terminal 51. In this embodiment, the radio-frequency connector assembly is a multi-path connector. Particularly, as shown in FIG. 2 and FIG. 5, the male substrate 21 is provided with multiple male signal terminals 51; multiple female substrates 31 and multiple shielding frames 32 are disposed in the female connector 3, the female substrates 31 are in one-to-one correspondence with the shielding frames 32, each female substrate 31 is provided with a female signal terminal 52 matched with one male signal terminal 51, every two adjacent shielding frames 32 are fixedly connected, and preferably, every two adjacent shielding frames 32 are conductively fixed together.

Preferably, the shielding case 22 is provided with spacers 223, every two adjacent male signal terminals 51 is isolated by one spacer 223 which is conductive with the shielding case 22, and each spacer 223 is inserted into two adjacent shielding frames 32, so that signal interference between the signal terminals is avoided. It can be easily understood that "between the signal terminals" refers to "between the male signal terminals 51", "between the female signal terminals" and "between one male signal terminal 51 and the female signal terminal 52 matched with the male signal terminal 51".

As shown in FIG. 2 and FIG. 4, multiple protrusions 61 which conductively contact with the shielding frame 32 are disposed on two sides of the spacers 223, and the distance between every two adjacent protrusions 61 in a lengthwise direction of the spacers 223 is less than or equal to one quarter wavelength of the operating frequency of the radio-frequency connector assembly. To further improve the bonding force of the male connector 2 and the female connector 3, grooves 62 allowing the protrusions 61 to be buckled therein are formed in regions, corresponding to the protrusions 61, of the shielding frame 32. It can be easily understood that the spacers 223 conductively contact with the shielding frame 32 on two sides thereof after the male connector 2 and the female connector 3 are plugged and matched.

In this embodiment, to guarantee the structural stability of the spacers 223, the spacers 223 are fixed on the male substrate 21, and the spacers 223 and the male substrate 21 are integrally formed through injection molding by means of inserts, so that machining is easy. To guarantee that the spacers 223 are stably conductive with the shielding case 22 to realize good isolation between two adjacent male signal terminals 51, all regions of the top surfaces of the spacers 223 conductively contact with the top plate 221. Optionally, the spacers 223 are connected to the top plate 221 through a spot welding process.

As shown in FIG. 2, a gap is reserved between the front end face of each spacer 223 and the peripheral plate 222; or, at least one part of the front end face of each spacer 223 conductively abuts against the peripheral plate 222.

Embodiment 2

Figure 6:
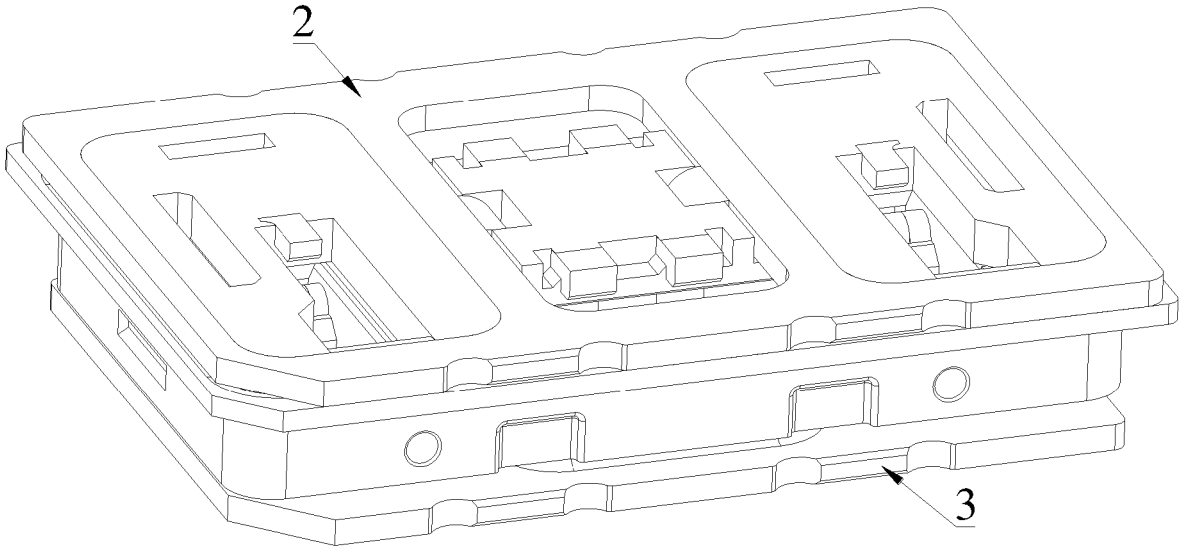
FIG. 6 is an overall structural view of a radio-frequency connector assembly in Embodiment 2 of the invention.
Figure 7:
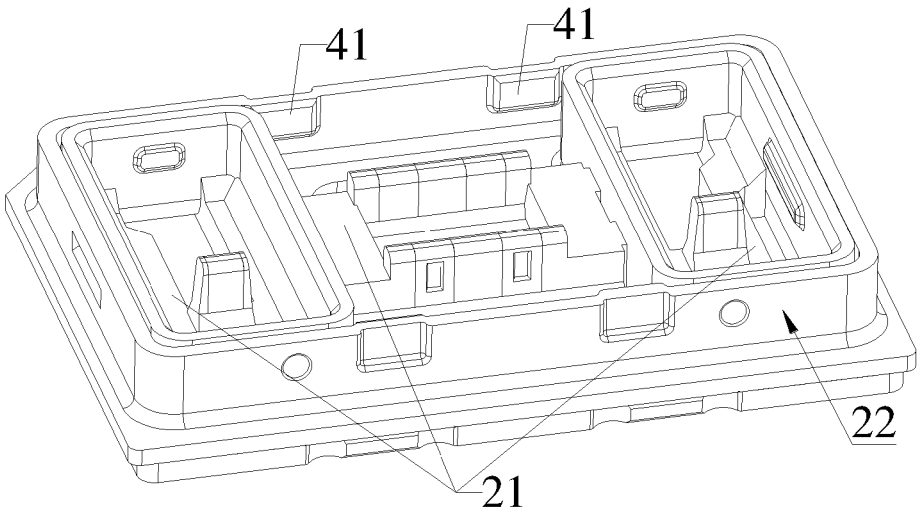
FIG. 7 is a structural view of a male connector of the radio-frequency connector assembly in Embodiment 2 of the invention.
Figure 8:
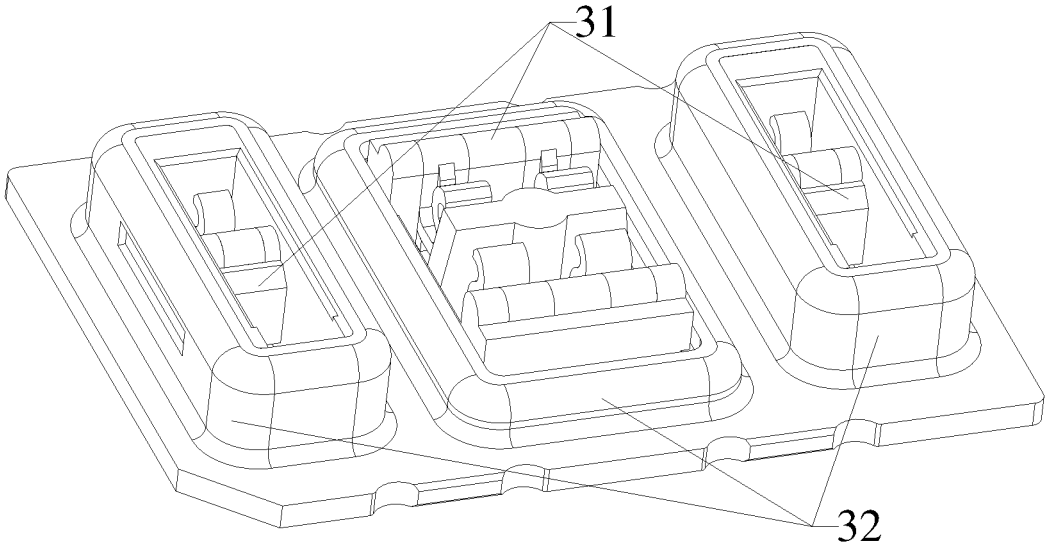
FIG. 8 is a structural view of a female connector of the radio-frequency connector assembly in Embodiment 2 of the invention.

Referring to FIG. 6 to FIG. 8, Embodiment 2 of the invention is another technical solution put forward on the basis of Embodiment 1. Different from Embodiment 1 in which the radio-frequency connector assembly is a wire-to-board radio-frequency connector, the radio-frequency connector assembly in this embodiment is a board-to-board radio-frequency connector. That is to say, the technical solution of this application is not only suitable for wire-to-board radio-frequency connectors, but also suitable for board-to-board radio-frequency connectors.

In this embodiment, the radio-frequency connector is a six-path board-to-board radio-frequency connector and comprises a male connector 2 and a female connector 3 plugged and matched with the male connector 2, wherein the male connector 2 comprises a male substrate 21 and a shielding case 22 which covers the male substrate 21, the female connector 3 comprises a female substrate 31 and a shielding frame 32 which covers the female substrate 31, and after the male connector 2 and the female connector 3 are plugged together, the shielding case 22 covers the shielding frame 32.

Particularly, multiple bumps 41 which are distributed around the shielding frame 32 are disposed on an inner peripheral wall of the shielding case 22, and the distance between every two adjacent bumps 41 is less than or equal to one quarter wavelength of the operating frequency of the radio-frequency connector assembly. Of course, it is also feasible to dispose the bumps 41 on the outer peripheral wall of the shielding frame 32.

To sum up, according to the radio-frequency connector assembly provided by the invention, signals in the X-axis/Y-axis/Z-axis direction can be shielded in the connector and are prevented from being radiated to the outside of the connector, thus avoiding signal leakage; moreover, signals from the outside of the connector can be prevented from entering the connector, so that signal interference is avoided; the shielding effect of the radio-frequency connector is effectively improved, and the electrical properties of the radio-frequency connector are improved.

The above description is merely for explaining the embodiments of the invention, and is not intended to limit the patent scope of the invention. All equivalent transformations made on the basis of the contents of the specification and accompanying drawings of the invention, or direct or indirect applications to relating technical fields should also fall within the patent protection scope of the invention.

The invention claimed is:

1. A radio-frequency connector assembly, comprising:

a male connector; and a female connector plugged and matched with the male connector, the male connector comprising a male substrate, the female connector comprising a female substrate, the male connector further comprising a shielding case which covers the male substrate, the female connector further comprising a shielding frame, the female substrate being disposed in the shielding frame which is covered with the shielding case, wherein multiple bumps which are distributed along an inner peripheral wall of the shielding case are disposed on at least one of the inner peripheral wall of the shielding case and an outer peripheral wall of the shielding frame, and a distance between every two adjacent bumps is less than or equal to one quarter wavelength of an operating frequency of the radio-frequency connector assembly.

2. The radio-frequency connector assembly according to claim 1, further comprising:

a radio-frequency line and a circuit board, wherein the male connector is connected to the radio-frequency line, and the shielding case is conductive with a ground terminal of the radio-frequency line, and the female connector is connected to the circuit board and is of a peripherally-seamless structure, a bottom of the shielding frame contacts with the circuit board, and an annular contact region is formed.

3. The radio-frequency connector assembly according to claim 2, wherein an edge guard which extends outwards is disposed at the bottom of the shielding frame.

4. The radio-frequency connector assembly according to claim 1, wherein the shielding case comprises a top plate, and a peripheral plate is arranged on an edge of the top plate and is a of peripherally-closed structure with a line inlet.

5. The radio-frequency connector assembly according to claim 1, wherein the shielding case is buckled on the shielding frame through the bumps, and slots matched with the bumps are formed in regions, corresponding to the bumps, of the inner peripheral wall of the shielding case or of the outer peripheral wall of the shielding frame.

6. The radio-frequency connector assembly according to claim 1, wherein the male substrate is provided with a male signal terminal, and the female substrate is provided with a female signal terminal matched with the male signal terminal.

7. The radio-frequency connector assembly according to claim 1, wherein the male substrate is provided with a plurality of male signal terminals, and every two adjacent male signal terminals, of the plurality of male signal terminals, are isolated by a spacer, which is conductive with the shielding case, a plurality of male substrates and a plurality of shielding frames are disposed in the female connector, each of a plurality of female substrates is in a one-to-one correspondence with a shielding frame of a plurality of shielding frames, each female substrate is provided with a female signal terminal matched with one of the male signal terminals, every two adjacent shielding frames are fixedly connected, and the spacer is inserted between two adjacent shielding frames, so that signal interference between the signal terminals is avoided.

8. The radio-frequency connector assembly according to claim 7, wherein multiple protrusions which conductively contact with the shielding frames are disposed on two sides of the spacers, and a distance between every two adjacent protrusions in a lengthwise direction of the spacers is less than or equal to one quarter wavelength of the operating frequency of the radio-frequency connector assembly.

9. The radio-frequency connector assembly according to claim 7, wherein the shielding case comprises a top plate, and all regions of top surfaces of the spacers conductively contact with the top plate.

10. The radio-frequency connector assembly according to claim 9, wherein a peripheral plate is disposed on an edge of the top plate and is a peripherally-closed structure with a line inlet, and a gap is reserved between a front end face of each spacer and the peripheral plate; or, at least one part of a front end face of each spacer conductively abut against the peripheral plate.

* * * * *